US005121833A

United States Patent [19]

Lindsay et al.

[11] Patent Number: 5,121,833

[45] Date of Patent: Jun. 16, 1992

[54] JEWELRY DISPLAY AND TRAVEL DEVICE

[76] Inventors: Susan L. Lindsay; Robert F. Lindsay, both of 1412 4th Ave. North, Great Falls, Mont. 59401

[21] Appl. No.: 699,578

[22] Filed: May 14, 1991

[51] Int. Cl.[5] ..... A45C 11/16; B65D 73/00; B65D 65/10

[52] U.S. Cl. ..... 206/6.1; 206/566; 206/486; 206/18

[58] Field of Search ..... 206/6.1, 566, 486, 487, 206/488, 489, 490

[56] References Cited

U.S. PATENT DOCUMENTS

| | | | |
|---|---|---|---|
| 1,574,192 | 2/1926 | Gutterman | 206/6.1 |
| 3,525,376 | 8/1970 | Muhlhauser | 206/6.1 |
| 3,900,060 | 8/1975 | Shammas | 206/6.1 |
| 4,388,959 | 6/1983 | Handy et al. | 206/6.1 |
| 4,401,219 | 8/1983 | Mink | 206/6.1 X |
| 4,821,883 | 4/1989 | Miller | 206/486 X |
| 4,848,562 | 7/1989 | Liu | 206/566 |
| 4,930,635 | 6/1990 | Hotchkiss et al. | 206/6.1 X |
| 4,958,727 | 9/1990 | Bergeron | 206/6.1 |

*Primary Examiner*—William I. Price

[57] ABSTRACT

A device for easing selection of, securely storing, protecting, displaying, and transporting items that can be attached to its woven face, loops, fastener ended straps, or contained within its compartment. The device is flexible, rectangular, and planar when unrolled and hangs suspended from a cord and a stiff bar with end caps. It has a front piece with a surface with a plurality of apertures and is interspersed with various attachments for articles such as jewelry, and including a detachable mirror and a detachable timepiece. Behind this layer is the back piece composed of fabric enclosing padding. The facing surfaces between the pieces of the front and back are coated with a frictionable substance that will contribute to holding the items fastened to the device and prevent them from moving around. When items are attached to the device, those not contained within a compartment will be displayed in an attractive manner that will be enhanced by the design of the device. When the device is rolled up and securely fastened, the contents within are protected from each other and external forces by the padded layer and rigid bar and are prevented from slipping out by the friction caused by a combination of the pressure from the compressed padding and the friction enhancing coated surfaces between the layers. Because the device is continuous in a circular manner as seen from the Y axis, it forms a trough at the bottom, any items such as earring clasps that may fall during attachment will be easily retrieved from the device. Attached to the bottom interior is a sleeve like slipcase, with a center cinch strap and a closure at its open end, that slides over the device and keeps its contents tightly contained and additionally protected when prepared for travel. This device offers economy of space, ease of conversion from display to travel mode and back again, and ease of access and selection of its contents when displayed.

3 Claims, 2 Drawing Sheets

JEWELRY DISPLAY AND TRAVEL DEVICE

BRIEF DESCRIPTION

1. Field of the Invention

This invention is directed to a jewelry holder in that it will store, protect, display, and ease selection and transportation of most types of jewelry including large scale commercial applications.

2. Prior Art

References Cited: U.S. Pat. Nos.

D. 103,012, 5/1870, Button
712,806, 11/1902, Kaffeman
1,171,896, 2/1916, Simpson
3,525,376, 8/1970, Muhlhauser
4,401,219, 8/1983, Mink
4,720,012, 1/1988, Dufour
4,760,920, 8/1988, Thomsen
4,821,883, 4/1989, Miller

BACKGROUND OF THE INVENTION

The problem of selecting, storing, protecting, displaying, and transporting jewelry is as old as recorded history. Various forms of containers such as compartmented boxes, pocketed rolls, padded trays, and perforated hangings all performed the function of carrying and protecting jewelry. Unfortunately the current art is still at this stage with no serious improvement in recent history. While attempts have been made to improve the versatility of the designs, all prove to be cumbersome, difficult to work with, or limited in application, among other shortcomings. What is ideal is to have a device that will allow its contents to be securely attached and protected from adverse conditions during transport, be easily used in that it will not be difficult to view, select, remove, and attach its contents, and prepare it for either display or travel.

Certain inventions have come close to reaching this ideal but have been difficult to work with. For example, U.S. Pat. No. 4,401,219 to Mink uses hook and loop attached plastic compartments on a mesh background that makes it difficult to open and close the compartments or remove or insert the contents easily. The contents are not well protected and the invention is stiff from the excessive use of hook and pile fasteners and not very compact. This new invention uses a flexible material that separates the contents on it by simply attaching the jewelry to the material directly. Because it is flexible it rolls up compactly and protects its contents from harm by means of integral padding in the back piece. Another example of limited application is U.S. Pat. No. 4,821,883 to Miller which causes post type earrings to be pushed through a mesh material and a sheet of craft foam. If an earring post loses its backing it will drop off of the device. Also, there are other types of earrings commonly available without backings and the Miller device does not allow these to be attached. When Miller's device is rolled the rear posts of the earrings will gouge or mar the exposed front surface of the other earrings displayed there and whatever surface it rests against. The new device allows all currently available pierced type earrings, as well as many other kinds of jewelry, to be attached. For example on the new device there are loops for attaching clip-on earrings, and snap-ended strips for attaching finger rings. It has a separate back piece that protects the jewelry and adjacent surfaces from harm by shielding the rear of the earrings from the front when rolled up. Plus by having the back piece longer than the front overall, the front piece carrying the jewelry will not bind with the rear due to the rear rolled up diameter being larger than the front rolled up diameter. Also, if an earring loses its backing it will be captured for easy retrieval in the trough formed where the back piece joins the front piece at its bottom. Further, by virtue of the attached slipcase, items that may come loose during travel will be contained if they evade the trough.

The ease with which jewelry can be retrieved has also been a problem for users in the past. U.S. Pat. No. 4,760,920 by Thomsen is lacking in this case because it must be laid flat upon a surface and, its stiff panel when lifted, will allow dangling contents to move around and become tangled because it pivots on a single hinge. This new invention hangs from any protrusion that will accommodate its cord, as well as lay upon any surface. The contents are easily retrieved because the jewelry holding surface is flexible with no set hinge point. Plus, the front and rear flexible pieces are of different widths, with the rear being wider than the front so that slipping a hand between the layers is easily facilitated.

This new invention has some additional utility not found on any previous art. The surfaces of the front and back pieces that face each other are coated with a frictionable substance that improves the devices ability to hold jewelry in place during transport, and a separate compartment is provided to hold items that cannot be attached to the device by any other means. Because certain situations may require that jewelry be donned when a mirror is not available, one is attached to the front face of the device. A timepiece is also attached near the mirror. Both the mirror and timepiece are detachable so the device can be easily cleaned. When the device is encased and prepared for travel, the slipcase has a cinch strap to hold its contents snugly, and a draw string closure acts as a convenient carrying handle. All the features of this new device are intended to provide the user with a safe, convenient, dependable, and attractive means for storing, protecting, displaying, selecting, and transporting jewelry and accessories.

SUMMARY OF THE INVENTION

It is the object of this invention to provide a new and improved means of selecting, storing, protecting, displaying, and transporting jewelry such as, but not limited to: pierced and clip-on type earrings, finger rings, bracelets, necklaces, broaches, watches, pins, eyeglasses, etcetera.

The invention when in its display mode hangs by a strong cord and an integral rod to provide planar stability. The face of the front piece is comprised of a flexible material with a plurality of apertures upon which is permanently attached loops, snap-ended strips, compartments, and a hook and loop attached mirror and timepiece. The rear side of this front piece is coated with a frictionable substance, such as latex, which will not obstruct the apertures. Upon the front piece can be attached pierced type earrings, broaches or any device that can pierce the surface and remain suspended there. The closed ended loops can hold clip-on earrings, clasp type bracelets and necklaces, etc. The snap-ended strips can hold finger rings, non-clasp bracelets and necklaces, etc. The compartments can hold eyeglasses, solid form bracelets, cosmetics, etc. The hook and loop attached mirror is provided so that the user will be able to don the jewelry and cosmetics carried upon it when other means of observing oneself are not available. The hook and loop attached timepiece is for assisting the user in keeping on a schedule. Both the mirror and the timepiece are removable so that the device may be cleaned. The back piece is comprised of tight weave fabric enclosing soft padding. The back piece is wider overall than the front piece so that it is easy to separate the two pieces by sliding a hand between them so that the backing of an attached earring can be grasped. The front surface of the back piece that faces the rear surface of the front piece is coated with a similar frictionable substance as the front piece so that any item protruding through the front piece will be sandwiched by the frictionable coated surfaces and thus rendered immobile. These two pieces are attached at the top and bottom so that they will not come apart, and if objects, such as the backings for post earrings, are dropped during removal and attachment, they will fall into the trough formed by the joint at the bottom. The back piece is longer overall than the front piece so that there is no binding when rolling the device from the top down over the front caused by the front and back pieces having different diameters. When the invention is rolled up and securely fastened with its contents inside, the pressure formed by the sandwiching material and padding, as well as the friction caused by the two coated inner surfaces, prevents loss and damage of its contents during transport. The whole device is then encased inside the attached slipcase. The slipcase is then cinched firmly about its circumference by the exterior straps and its open end is closed by a strong drawstring with a friction anchor to provide a sealed container for the contents. The loop formed by the drawstring then acts as a carrying handle. When the device is ready to be displayed it is simply unrolled and hung or laid on any available surface for view and selection of its contents. The attached slipcase is then hidden from view by the user.

DESCRIPTION OF THE INVENTION

DESCRIPTION OF THE PREFERRED EMBODIMENT

Figure 1:
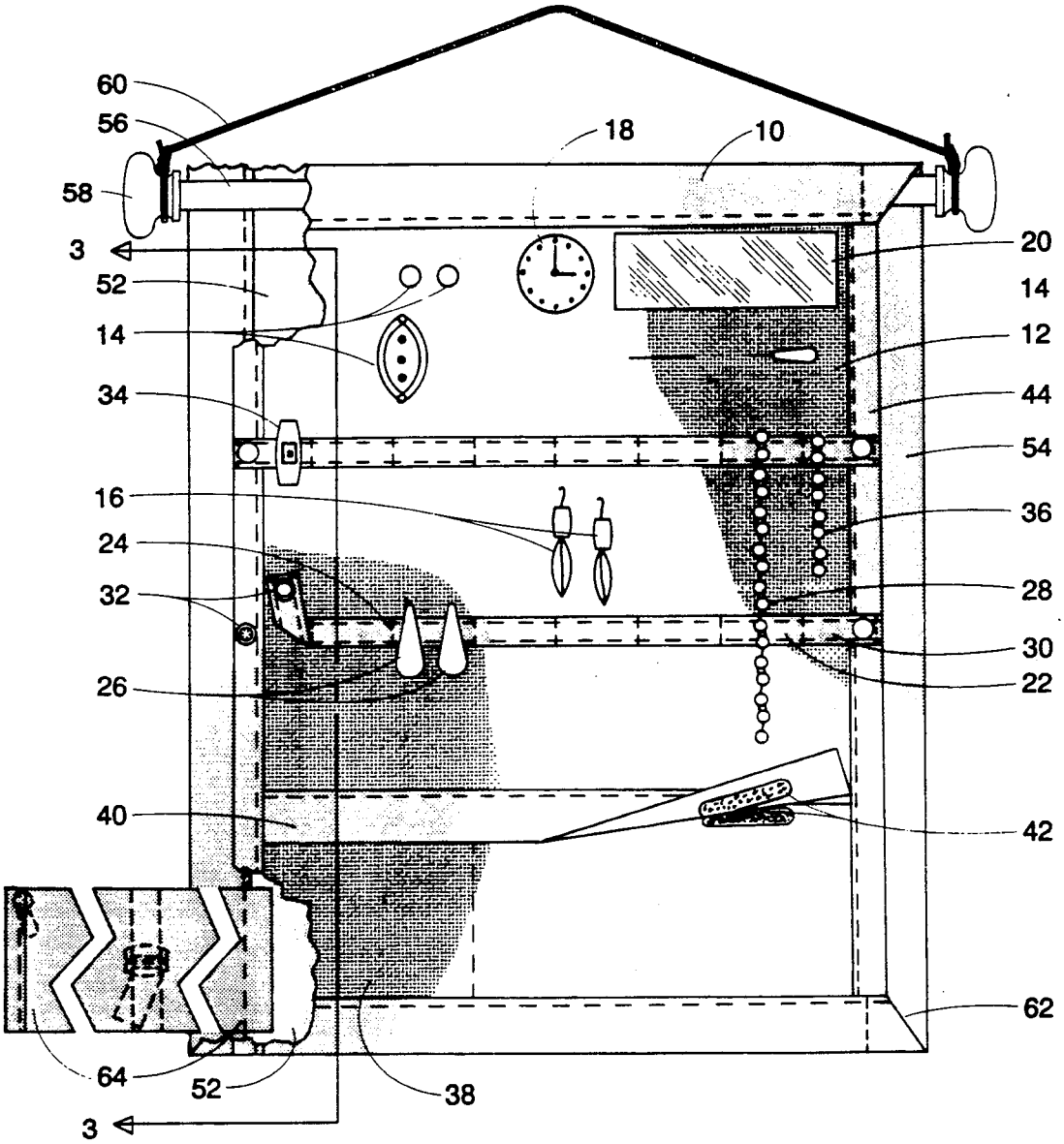
FIG. 1 is a front plan view of the device showing it in the display mode with some sample contents.
Figure 2:
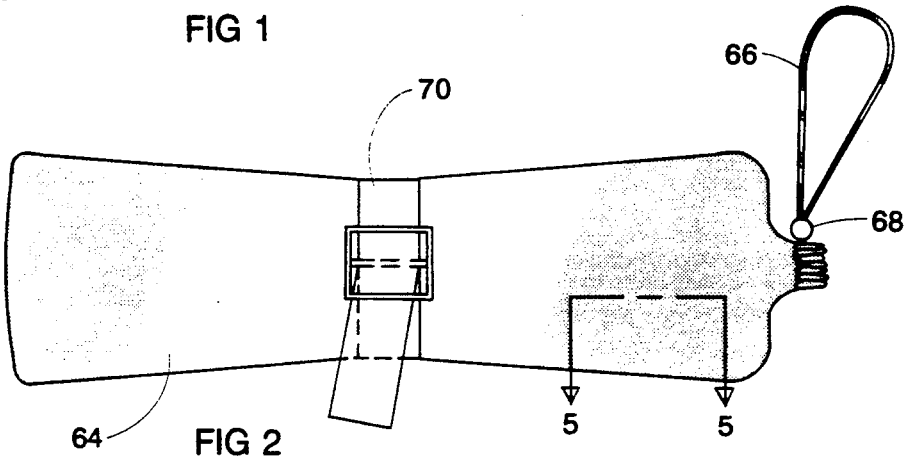
FIG. 2 is a view of the device after it has been rolled up and contained by its attached slipcase and is ready for transport.
Figure 3:
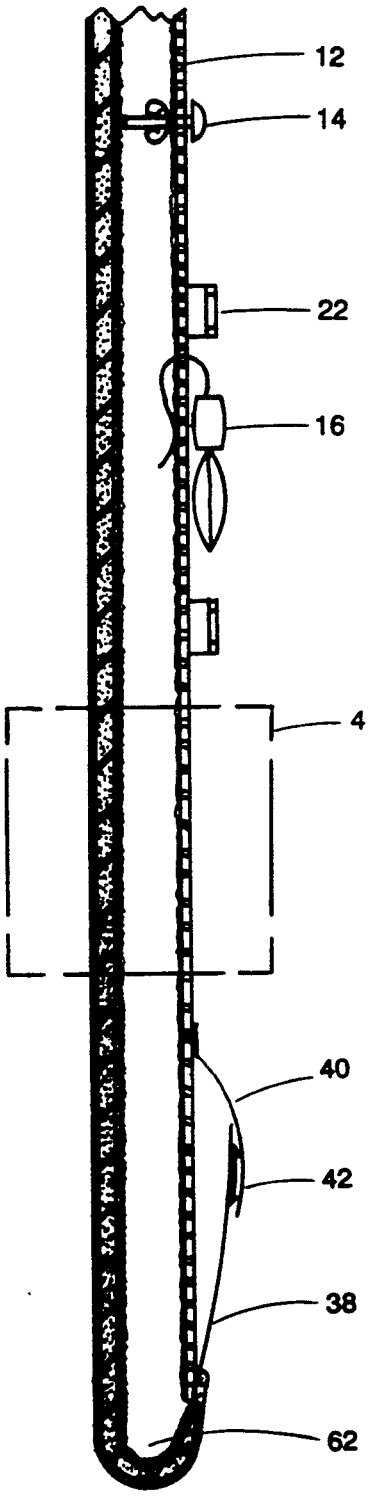
FIG. 3 is a side view of the device taken along lines 3—3 of FIG. 1.
Figure 5:
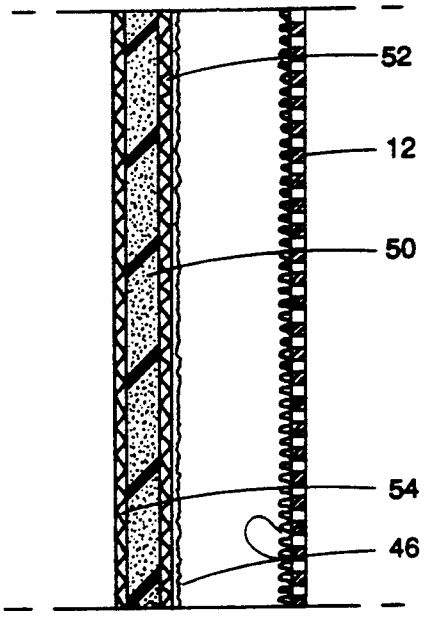
FIG. 5 is a view along lines 5—5 of FIG. 2 showing how items carried inside the device are protected.
Figure 4:
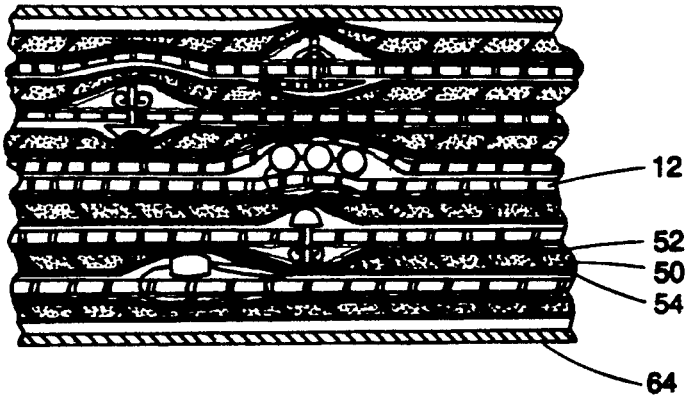
FIG. 4 is an enlargement of the device from FIG. 3 showing a detail of its materials.

An exemplary embodiment of the jewelry display/-travel device is illustrated in the drawings, and generally designated 10.

The device 10 includes a rectangular front piece 12 that is a flexible material containing a plurality of apertures throughout its entire surface, aida cloth and upholstery cloth are examples. Post type earrings, pin-on broaches, and decorative pins 14 and hook type earrings 16 are mounted through the apertures on this front piece 12. Attached at the top of the front piece by means of hook and pile fasteners is a timepiece 18 and mirror 20 that can be detached so that the device may be cleaned.

Attached to the front piece 12 at even intervals on its plain and facing the user, are thin strips of flexible material 22 that are tacked 24 at several points along the length to the material 12 so as to form closed loops for holding clip-on earrings 26 and clasped necklaces 28, etc. The free ends of these strips 30 are attached to the front piece 12 at one end by one of the tacked points and are closed at the other end by snaps 32, or any other means, to form a loop to hold finger rings 34 and no-clasp bracelets 36, etc. Attached to the bottom of the front piece 12 is a compartment made of flexible material 38 that is sewn on three sides to material 12 with its upper part open and covered by a flap of material 40 attached to the front piece 12 at the top of the flap. The two materials 38 and 40 are secured together by means of hook and pile fasteners 42, or any other kind of fastener, so that anything contained within the compartment will be kept safe from loss. This compartment holds various types of jewelry or other items that for one reason or another cannot attach by other previously mentioned means.

Along the two vertical edges of the entire front piece 12 is attached a flexible binding material 44 that will protect the edge of the holding surface and is of an aesthetically appealing color, to create a frame effect around the front piece. The entire reverse side of the front piece 12 is coated with a frictionable substance 46, such as latex, that will not interfere with the penetration of the apertures by a piece of jewelry.

The back piece of the device is designed to afford maximum protection to the contained jewelry by providing cushion and shielding from outside forces and by preventing collision of jewelry inside. Comprised of three pieces: a flexible padded core 50 enclosed on the front side by a tight weave flexible material 52 that is coated on one side with a frictionable substance 46 and faces against the coated side of material 12 so that the two coated surfaces oppose each other, and the opposite side is uncoated and tacked to the padded core 50; the padded core 50 is enclosed on the back side by a tight weave material 54 which is not coated and is wider along the X axis than the padded core 50 so that it wraps around the padded core and attaches to the coated material 52 thus completely encasing the padded cord entirely. The back piece is joined to the front piece and back to itself at the top after having formed a loop about a stiff rod 56. The rod is capped on each end by a larger diameter piece 58. The device is suspended by a flexible cord 60 that attaches to the rod end caps 58. The back piece is joined to the front piece at the bottom below the compartment 38 to form a trough 62 that is used to catch small earring backing that slip out of a users fingers, among other things. Overall the back piece is wider along the X axis and longer along the Y axis than the front piece to make rolling of the device easier, and facilitate the sliding of hands between the layers. Between the front piece and back piece at the bottom and attached to the seam joining the tight weave materials of the back piece is a flexible tubular slipcase 64. The slipcase is sealed at its open end by means of a draw string 66 and a friction anchor 68, or any other method. The slipcase has attached one or more cinch straps 70 around its circumference for increasing and decreasing the slipcases usable diameter thus adding pressure on the rolled up device so that its contents are more firmly held. To use the device, one inserts jewelry such as post type earrings, pins, or broaches 14, or hook earrings 16 through the apertures in the holding surface 12. If the item such as a post type earring 14 requires a backing to be put on it, one places a hand between the front piece and back piece, as facilitated by the back being wider than the front, and and places the backing on the post. Clip on earrings 26 or clasped chains 28 are placed around the loops 22. Finger rings or continuous circle chains are secured by passing the end of the loose strip 30 through the hole in the jewelry and fastening the snap on the end 32. Items that are desired to be carried but are unable to be attached are secured in a compartment 38. When preparing for transport all dangling items or long objects must be arranged along the X axis to prevent breakage while the device is being rolled. The cord 60 is pressed tightly to the top, and the top is then rolled toward the bottom over the front piece 12 with sufficient tension so as to press the padded backing onto the carried items but not to cause breakage. The slipcase 64 is pulled out during travel preparation and is slipped over the end of the rolled up device so that the slipcase turns inside out during the encasement. The drawstring 66 is then tightened with the friction anchor 68 to close the end of the slipcase and the cinch straps 70 are tightened to provide adequate tension to allow the padding and the frictionable surfaces to press against the contents and prevent the contents from moving.

We claim:

1. A generally planar flexible device for easing selection of, securely storing, protecting, displaying, and transporting jewelry such as post-type with clasp earrings, clip-on type earrings, hook-type earrings, bracelets, necklaces, broaches, finger rings, etcetera which comprising:

a generally planar flexible front piece formed of a flexible sheet with a plurality of apertures on the face of which said jewelry that has a post type attachment can pass said post through a said aperture and be secured to the face of the device by means of a clasp attached to the distal end of said post which shall prevent said post from passing back through said aperture by nature of the fact that said clasp will be of a larger size than said aperture, and of which said jewelry having a hook type attachment can pass said hook through a said aperture and be suspended upon said flexible sheet by nature of said hook; and on the face of said flexible sheet of which is attached numerous loops so that said jewelry with a clip-on type attachment can pass the catchment part of the clip over said loop and grasp said loop so that friction will prevent said jewelry from coming off of said loop; and on the face of said flexible sheet of which is attached numerous straps that are free on one end with a detachable fastener at said end so that said jewelry that is of a continuous form such as common finger rings can pass said strap through an opening in said jewelry and then attach said fastener back to the face of said flexible sheet so that said jewelry will be unable to come off of said strap unless said fastener is detached; and on the face of said flexible sheet of which is attached by means of hook and pile fasteners is a detachable mirror that will show the reflection of a user of said device, and a detachable timepiece which is attached by means of said hook and pile fasteners that will show the user the desired time; and on the face of said flexible sheet of which is attached a compartment that is fastened to said flexible sheet on said compartment's bottom and right and left sides and is open at the top so that said compartment can receive pieces of said jewelry that cannot be attached to said front piece by said previously mentioned means; and the opposite side of said flexible sheet which is coated with a frictionable substance that will not obstruct said apertures and has as its property the ability to cause portions of said jewelry that rest against it to be restricted in movement so that said jewelry will not impact undesirable objects and fall off of said flexible sheet; and a generally planar back piece comprised of a flexible soft core covered with a durable material that is coated on one side with a frictionable substance and will not allow a post from said jewelry to pass through it without great effort; and said front and said back piece are joined at the top to form a loop to contain a rod for hanging, and joined at the bottom to form a trough, and joined so that said frictionable substance coated sides oppose each other; and when said device is rolled up said back piece will protect said jewelry from internal and external forces and by means of said frictionable substance and pressure from said backing will prevent said jewelry from moving; and attached to said back piece so that it is hidden from view is a tubular protective slipcase that is open on one end and closed on the end attached to said back piece, and said rolled device is passed through said open end of said slipcase so that while said device is being encased said slipcase turns inside out; and that said slipcase has a cinch strap about its circumference to provide positive control to the amount of friction applied to said rolled up device inside said slipcase; and that said slipcase has at said open end a locking closure to prevent any contents inside said slipcase from accidentally falling out.

2. The device of claim 1 wherein the back piece is overall longer than the front piece so that as the device is rolled from the top down over the front piece the difference in diameters of said front and back pieces is compensated for, and said back piece is overall longer than said front piece upon completion of said rolling.

3. The device of claim 1 wherein the back piece is overall wider than the front piece to facilitate the placement of a hand between said pieces by allowing the edge of said back piece to be pressed away from said front piece and thus allowing a gap to be formed between said pieces such that a hand can be slid along the frictionable coated surface of said back piece and the attachment means of a piece of jewelry can be grasped.

* * * * *